US005402569A

United States Patent [19]

Maki et al.

[11] Patent Number: 5,402,569

[45] Date of Patent: Apr. 4, 1995

[54] METHOD OF MANUFACTURING A PUMP WITH A MODULAR CAM PROFILE LINER

[75] Inventors: Bruce A. Maki, Warren; David L. Thompson, Clinton Township, Macomb County, both of Mich.

[73] Assignee: Hypro Corporation, St. Paul, Minn.

[21] Appl. No.: 202,360

[22] Filed: Feb. 28, 1994

[51] Int. Cl.[6] ..... B23P 15/00

[52] U.S. Cl. ..... 29/888.025; 29/888.02; 29/463

[58] Field of Search ..... 29/888.02, 888.025, 29/463; 415/197, 170.1; 418/63, 243, 244–251

[56] References Cited

U.S. PATENT DOCUMENTS

| | | | |
|---|---|---|---|
| 4,466,785 | 8/1984 | Biswas | 29/888.025 |
| 4,782,569 | 11/1988 | Wood | 29/888.024 |
| 5,040,946 | 8/1991 | Caoduro | 29/888.025 |

FOREIGN PATENT DOCUMENTS

| | | | |
|---|---|---|---|
| 1145172 | 3/1985 | Japan | 29/888.025 |
| 0216745 | 10/1985 | Japan | 29/888.025 |
| 0081591 | 4/1986 | Japan | 29/888.025 |

*Primary Examiner*—Irene Cuda

*Attorney, Agent, or Firm*—Haugen and Nikolai

[57] ABSTRACT

An improved method for manufacturing a sophisticated cam profile liner used in pumps and compressors. A non-circular cam profile liner is fabricated from multiple parts, preferably two identical cam liner halves mated together. Each cam profile liner half is generally crescent-shaped, and is manufactured from a single mold using conventional molding techniques. Window openings are formed in the cam profile liner without the need for hand-placing inserts in the mold. Further, no taper is formed in the cam profile liner. Accordingly, the present invention is suitable for use in precision sliding vane pumps, as well as flexible and roller-type pumps. Since each cam profile liner half is identical to the other, a symmetrical cam chamber is defined by the cam profile liner.

11 Claims, 3 Drawing Sheets

METHOD OF MANUFACTURING A PUMP WITH A MODULAR CAM PROFILE LINER

BACKGROUND OF THE INVENTION

CROSS REFERENCE TO A RELATED APPLICATION

Cross reference is made to related patent application entitled Pump Including Integral Reservoirs for Permitting Dry Run of Pump, file concurrently with this application and assigned to the assignee of the present application.

I. Field of the Invention

This invention relates generally to rotary fluid transfer devices, and more particularly to a method of manufacturing cam profile liners for use in rotary pumps and compressors of the sliding vane, roller and flexible (rubber) impeller-type.

II. Discussion of the Prior Art

Fluid transfer devices including rotary pumps and compressors are widely used in the industry for pumping and compressing fluids. These devices can be of the sliding vane, roller, or flexible (rubber) impeller-type. Cam profiles are implemented in rotary pumps and compressors to define a uniquely shaped pumping chamber that an impeller rotates therewithin. The cam profile, in combination with the rotating impeller, creates the suction and discharge forces required for processing the fluid. Typically, the cam profile consists of a liner (insert) securingly positioned within a cylindrical housing bore.

Circular cam profiles are used in many fields of industry. These circular cam profiles are designed with the principles of engineering to create radial displacement to a rotary device. Usually, the rotor is eccentrically positioned within the circular cam profile. These circular cam profiles find large usage in sliding vane pumps and compressors, roller pumps and flexible (rubber) impeller pumps. For these purposes, suction and discharge openings are included in the cam profile. These openings are necessary to allow a gas or a fluid to enter the profile within the pump.

Gas or liquid enters the cam profile at an intake port, filling an increasing void as formed by the vane, flexible impeller, or rollers. This arcuate portion of the profile is referred to as Open To Suction (OTSi). The cam profile is so designed as to provide a smooth transition while opening to minimize mechanical and hydraulic forces on the vanes, rollers, or flexible impeller. From the OTS, the profile extends from the intake opening along a closed angular section, usually of constant radial dimension, whose purpose is to seal suction from discharge. This segment of the cam profile is referred to as Closed To Suction (CTS). The fluid is then forcibly discharged through an outlet port by the development of the cam profile section that is referred to as Open To Discharge (OTD). The cam profile past the discharge port then smoothly changes to another constant radial dimension for sealing the discharge port from the suction port. This portion of the profile is referred to as Closed TD Discharge (CTD). Finally, the profile smoothly changes back to the OTS section.

This cam profile is so contoured radially as to minimize radial accelerations, and hence, radial forces so as to minimize noise and optimizing life of the impeller vanes, rollers, or the flexible impeller. As shown, the cam profile is formed by an liner (insert) secured with the housing bore. Typically, the profile of the OTD section is a mirror image of thee profile on the OTS side of the cam profile. Fluid enters the cam profile through a set of windows formed in the cam profile at the inlet port, and flows out through another set of windows formed in the cam profile at the discharge port. These windows serve to support the vanes and rollers as they are swept past the openings.

Cam profiles have been fabricated in the past by a variety of means. Metal working methods usually are confined to two methods. The simplest method, is to machine a perfectly circular cam profile into the housing that is eccentric to the impeller rotating therewithin. The advantage of such a cam profile is ease of machining. The disadvantages are that the location of the ports must, in the case of incompressible fluids, be exactly located for correct timing, which positioning is difficult using machining. Further, the treatment of the impeller vanes or rollers is not necessarily ideal for the application. That is, the acceleration profile cannot be dictated by engineering needs.

More sophisticated profiles make use of mathematics to create a desired effect, such as constant velocity, constant acceleration, cycloidal profiles, etc. Such advanced cam profiles are highly desirable in pump and compressors as they clearly define the various phases of pumping, as well as provide the optimum profile for the longevity of the pump impeller by minimizing hydraulic and radial forces. Methods of machining advanced cam profiles in a housing consist of using programmed, computer controlled, milling machines to machine non-circular profiles into sliding vane, roller, or flexible (rubber) impeller pump bodies. Although effective, this technique is usually of high cost due to the machine cycle time required to create each profile.

These sophisticated continuous Cam profiles have also been produced in the past for flexible impeller pumps by means of one-piece molded cam liners inserted in the cylindrical cam housing bore, usually from a plastic material. Such one-piece molded designs are much less expensive than machined cam profiles. However, the one-step molding process requires that the tooling create the window openings in the cam liner for the intake and discharge ports. This necessitates complicated tooling, and/or the need for hand-placed inserts. These inserts create expensive tooling procedures, and slow the molding cycle rate considerably. The requirement to mold the windows in the cam liner also usually limits the mold die to a single cavity, which again, limits the production piece rate from the mold. Also, due to the need to withdraw the center mold contour, which contour forms the cam profile, a taper needs to be defined in the bore of the cam profile liner. This taper effects the pump performance, and in the case of precision sliding vane pumps, may be unacceptable.

OBJECTS

It is accordingly a principle object of the present invention to provide an improved method of manufacturing a cam profile liner with sophisticated profiles, but which requires significantly less expensive tooling.

Another object of the present invention is to provide a method of manufacturing a cam profile liner which does not have a tapered inner surface.

Still yet another object of the present invention is to provide a method of manufacturing a cam profile liner using molding and die casting techniques, yet which facilitates easy removal of a cam profile liner from the mold.

Another object of the present invention is to provide an improved method of manufacturing a camiprofile liner which is less expensive, and which eliminates the need for hand-placing inserts in the mold to form windows for the intake and discharge ports.

The foregoing objects and advantages are achieved by the present invention which will now being discussed in considerable detail in the following description, especially in view of the following drawings.

SUMMARY OF THE INVENTION

The foregoing objects and advantages are achieved by forming a sophisticated cam profile liner from two identical halves mated together, forming a symmetrical unit. Each cam profile half can be molded from a single mold without requiring hand-placed inserts or complicated tooling actuators. One simple split mold is inexpensive relative to molds with actuating devices. Furthermore, each cam profile half may be made in a multicavity configuration to greatly increase the production rate from a molding machine, which further reduces the cost of the part. Moreover, because of the parting line of the mold, the cam profile half can be molded without taper. The symmetry of the sophisticated cam liner allows it to be assembled from two identical halves using one mold. The cost of utilizing two cam halves is considerably less than the cost of a single molded cam liner, with tooling savings of up to 75%. In summary, the cost of manufacturing the cam profile liner is considerably reduced, the tooling required is more simple and less expensive, and the contour of the cam liner can be molded without a taper in the bore. This technique allows the ease of moldability and assembly of such pumps and compressors including sliding vane, roller, and flexible (rubber) impeller-type.

The method of manufacturing a device, such as a pump or compressor, having a cam profile with a chamber therewithin, wherein the cam profile has a fluid inlet port and a fluid output port formed therein in communication with the chamber, with a rotor rotatably mounted within the chamber, and with a motor connected to the rotor for driving the rotor, comprises the steps of first forming a plurality of cam profile units. Preferably, each cam profile unit is identical to the other, and is molded from a single mold. Next, at least two cam profile units are integrated together to form the cam profile. Thereafter, the rotor is integrated into the cam profile, and the motor is attached to this rotor. Preferably, each cam profile unit comprises one-half of the cam profile to be formed, and are positioned as mirror-images of the other when mated. Since the cam profile units are identical, the cam profile chamber formed is symmetrical. Each of the cam profile units are preferably formed of plastic material using conventional injection molding techniques. However, each of the cam profile units could be formed of metal using conventional die casting techniques. Each cam profile half is formed to have at least one opening which serves as either the fluid inlet port or the fluid outlet port once assembled to form a complete cam profile. Preferably, a plurality of these openings are provided in each cam half to form ribs therebetween. These ribs serve to support vanes or rollers as the rotor rotates past the opening.

DESCRIPTION OF THE PREFERRED EMBODIMENT

Figure 1:
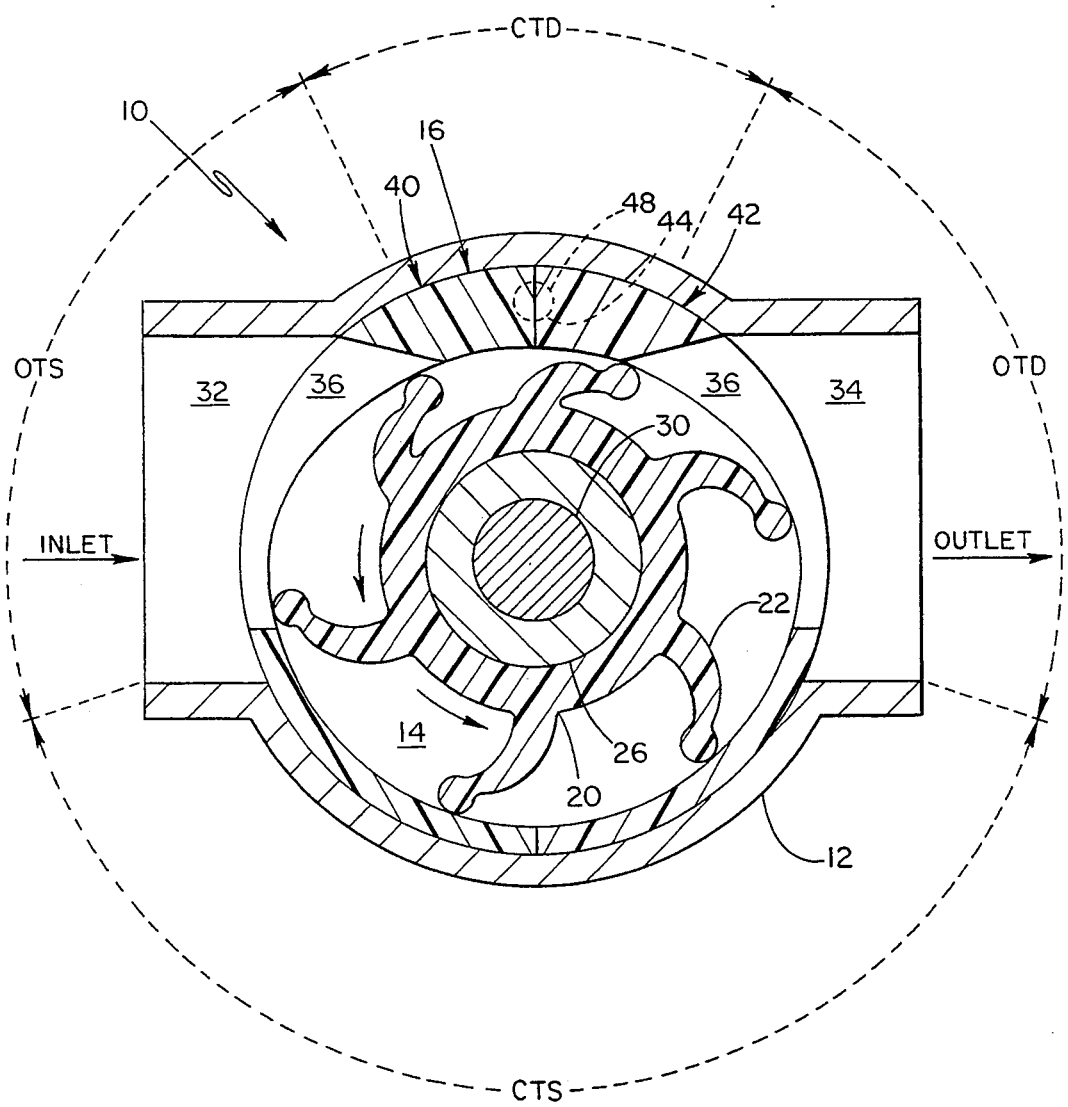
FIG. 1 is a sectional view of a pump manufactured according to the method of the present invention, wherein a cam profile liner is formed from two identical cam profile halves integrated together to form a symmetrical chamber therewithin.

Referring now to FIG. 1, a conventional pump is shown at 10 having a flexible impeller journaled for rotation within a cam profile, the profile being manufactured according to the preferred embodiment of the present invention. Pump 10 is seen to include a metal housing or cam profile 12 with a pump chamber 14 defined therein. A sophisticated cam profile liner generally shown at 16 is secured within this chamber, and forms a liner for the inside surface of housing 12. A flexible impeller or rotor 20 formed of neoprene is concentrically positioned with housing chamber 14 and includes a plurality of radially extending flexible vanes 22. Impeller 20 is eccentrically positioned within cam profile liner 16. Each vane 22 is seen to radially extend outward to engage the inner surface of cam profile liner 16. Liner 16 clearly defines the various phases of pumping, as labeled about the device. A brass annular rotor sleeve 26 is co-axially positioned and secured within rotor 20 for supporting the rotor hub, the sleeve being bonded to the rotor. A drive shaft 30 is axially disposed through sleeve 26 and rotor 20, and is cantleverly coupled to a drive motor positioned exterior of housing 12 (not shown). Rotor 20 is mounted on shaft 30, this shaft being journaled for rotation through housing 12.

A suction or inlet opening 32, and a discharge or outlet opening 34 are provided in housing/cam profile 12 to allow gas or fluid to enter the pump 10 and within cam profile liner 16. Each opening 32 and 34 opens to, and is in fluid communication with, a corresponding plurality of windows 36 separated by ribs 38 formed in cam profile liner 16. Openings 32 and 34, and windows 36 allow liquid to enter the cam profile chamber 14, filling an increasing void formed by the rotating flexible impeller 20 in combination with the cam profile liner 16. The arcuate portion or segment of the cam profile across inlet opening 32 is commonly referred to as Open To Suction (OTS), as shown in FIG. 1. The increasing radius of the cam profile liner inner surface along the arcuate OTS portion has a smooth transition, to minimize mechanical and hydraulic forces on the flexible impeller vanes, and to create suction as impeller 20 is rotated therepast.

The inner surface or bore of cam profile liner 16 next passes along a closed angular section or segment between the inlet port 32 and outlet portion 34, wherein the profile segment has a constant radial dimension. This portion of the cam profile liner is designed to seal suction from discharge, and is commonly referred to as Closed To Suction (CTS).

Fluid is then forcibly discharged through outlet 34 and windows 36 by the development of the cam profile liner 16 that is commonly referred to as Open To Discharge (OTD). This profile portion is contoured radially so as to minimize radial accelerations, and hence, forces as to minimize noise and optimizing life of the impeller vanes. The profile of the OTD segment is a mirror image of the OTS side of the cam profile liner 16. The segment between the OTD and the OTS portions of the cam profile is a portion commonly referred to as Closed To Discharge (CTD). The cam profile along the CTD smoothly has another constant radial dimension, this dimension being smaller than the CTS portion. Impeller pumps with unitary cam profiles are well known in the art.

In accordance with the preferred embodiment of the present invention, cam profile liner 16 is fabricated from a plurality of parts, preferably from a pair of identical cam profile liner halves 40 and 42 mated together. Accordingly, chamber 14 is symmetrical in shape, as shown. A pair of anti-rotation pins 44 are placed within a pair of elongated cylindrical notches 48, one defined each side of cam profile liner 16. Each notch 48 is formed by a pair of elongated recesses 46, one formed in each of the upper opposing mating surfaces of the respective cam halves. (See FIG. 2).

Figure 2:
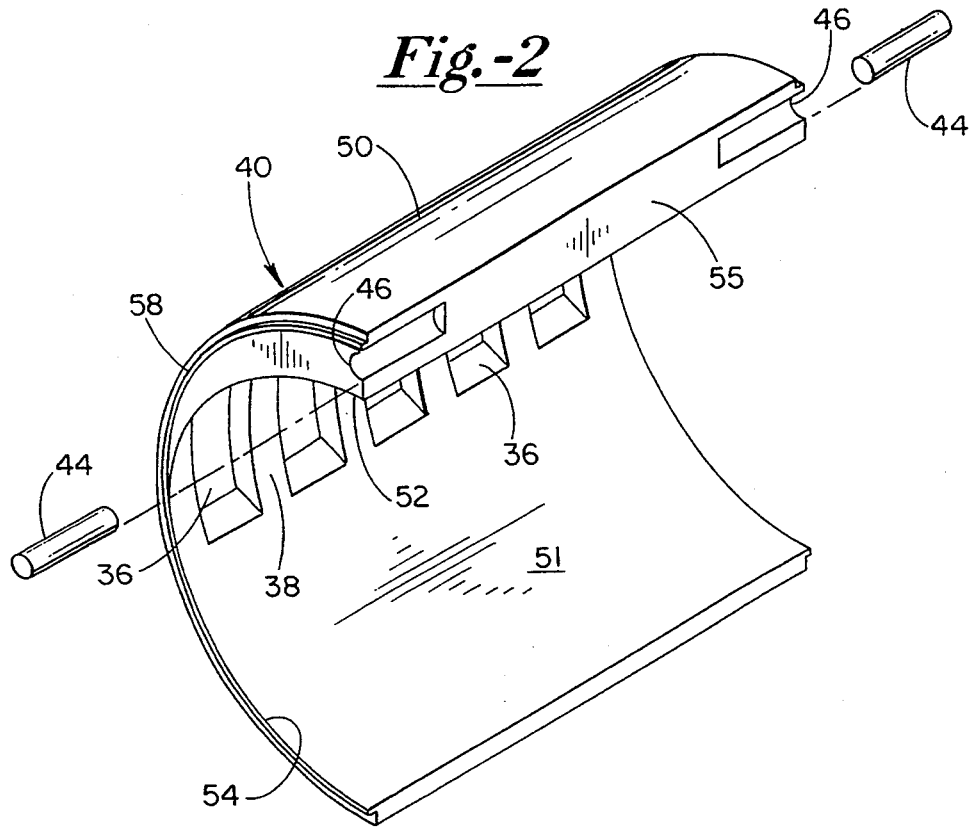
FIG. 2 is a perspective view of one cam profile liner half, the cam profile half having a plurality of windows for either suction or discharge, wherein the inner surface at the bottom of the half has a large constant radius smoothly extending upwardly to a smaller constant inner radius.

Referring to FIG. 2, a perspective view of one cam half is illustrated. Cam profile liner half 40 is identical to cam profile liner half 42, therefore, for purposes of illustration, just one cam profile liner half will be discussed in considerable detail. Cam profile liner half 40 has an outer surface 50 of a constant radius and forms a semi-circle. The inner surface 51 of cam profile liner half 40, however, is more sophisticated and smoothly changes from a constant radial dimension at the upper end 52 thereof, to a larger constant radial dimension at 54. The upper edge 55 of cam profile 40 is seen to include the pair of semicircular notches 46. These notches are opposed from the respective notches 46 of cam profile liner half 42 once assembled together to form the recesses 48 in the unitary cam profile 16, as previously discussed in regards to FIG. 1. The cylindrical recesses 48 each receive a respective anti-rotation pin 44. These pins extend outwardly, through the side plates (not shown), and into the housing 12 to prevent liner 16 from rotating within pumping chamber 14, thus forming a mechanical lock without the need for adhesives. Each of the outer rims of cam profile 40 are seen to have an annular shoulder portion 58 which facilitates securingly positioned the cam profile liner 16 within housing 12 during assembly.

Each of cam profile liner halves 40 and 42 are preferably manufactured using conventional plastic injection molding techniques. Cam profile liner half 40 is made as a multicavity configuration to include a plurality of windows 36 and notches 46 without requiring hand-placed inserts or complicated tooling with actuators. Even more importantly, the inside surface 51 of cam profile liner half 40 can be molded Without taper. Accordingly, pump performance is not degraded when Using precision sliding vane rotors. Preferable materials for cam profile liner halves 40 and 42 include phenolic, epoxy, and polyphenylene sulphide (PPS). However, each half could be comprised of metal using an investment casting process if desired.

Figure 3:
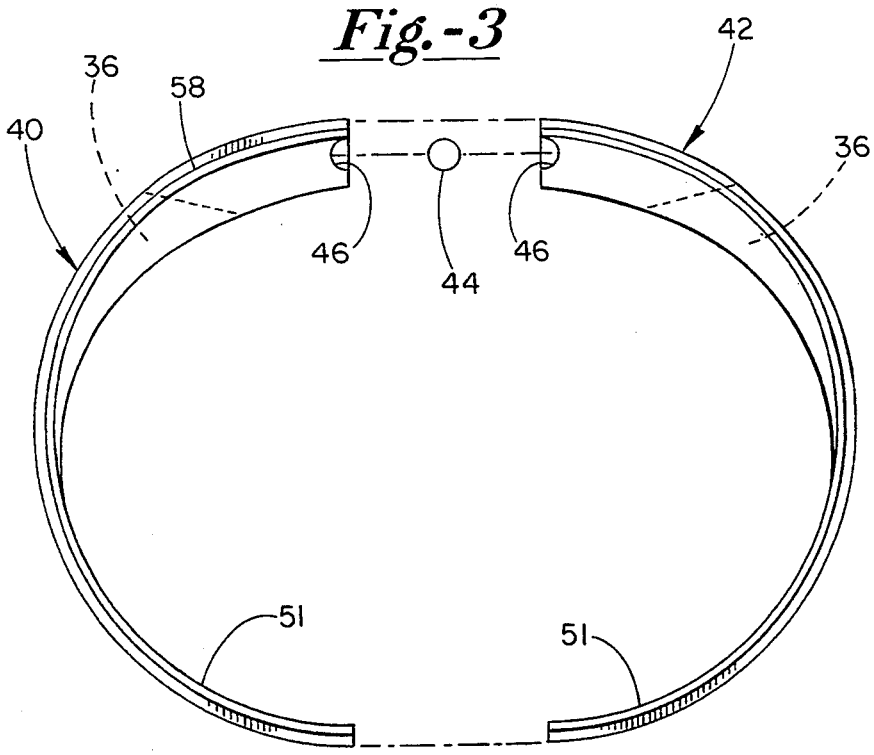
FIG. 3 is a side view of two identical cam profile liner halves positioned as mirror images while assembled into a cam profile to form a symmetrical chamber, such as that shown in FIG. 1.
Figure 4:
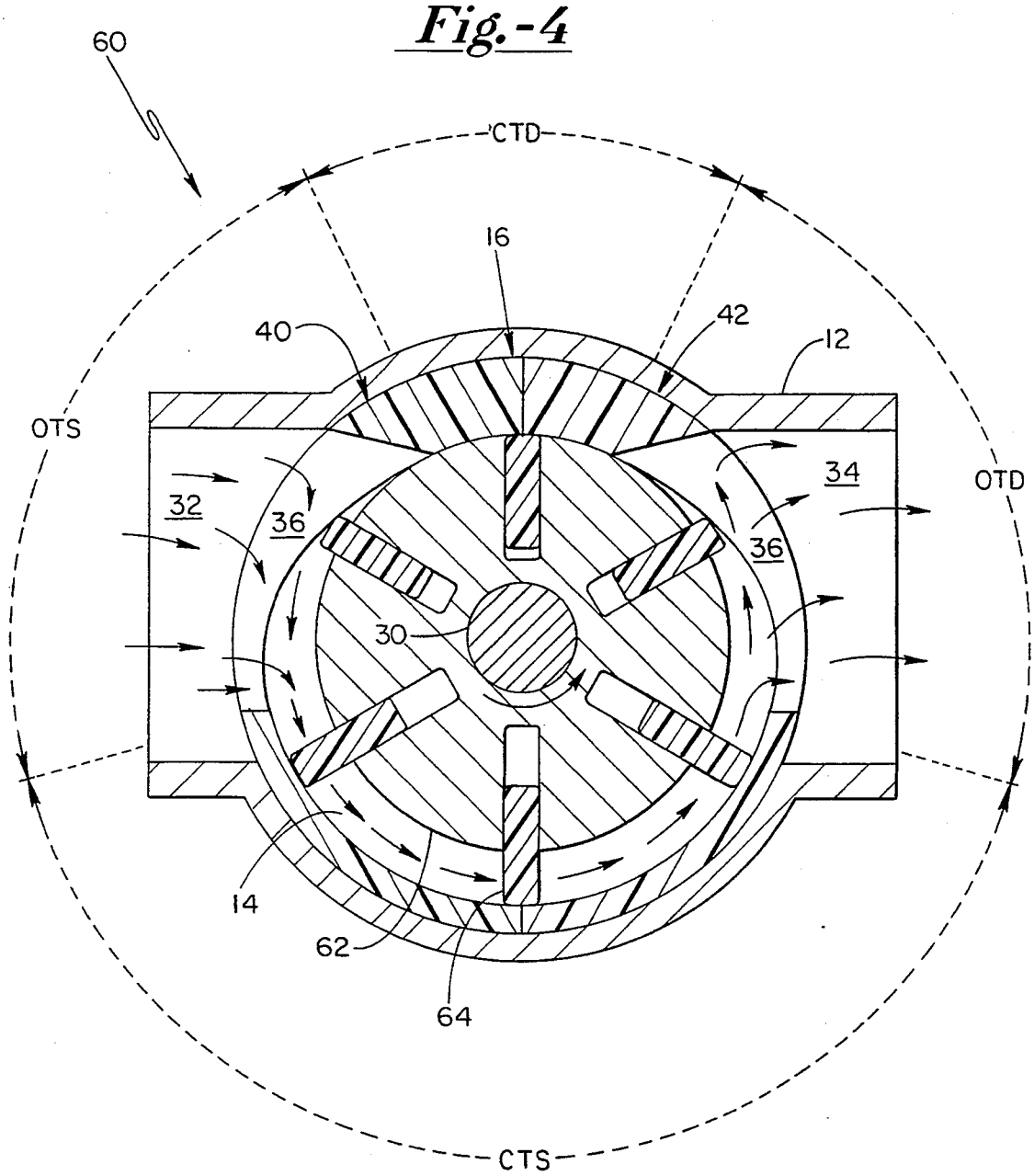
FIG. 4 is a sectional view of a typical vane-type pump with sliding vanes, wherein the cam profile liner is also manufactured from two identical cam profile halves.

Only one mold is required to manufacture each of cam profile liner halves 40 and 42 since they are identical. Referring to FIG. 3, identical cam profile halves 40 and 42 are shown opposed from one another as mirror images, and then mated together and assembled to form unitary cam profile liner 16. Since cam profile liner half 40 is a mirror image of cam profile liner half 42, the OTS and the OTD cam profile segments are identical. Each of the CTS and CTD cam profile segments have a constant radius, with a smooth transition being formed across the mating interface of the two cam profile liner halves. Pins 44 are placed within respective recesses 48, this assembly then being placed into the housing bore during assembly to provide a mechanical lock. The cam profile is sealed in the housing bore using conventional techniques. A cover plate (not shown) is attached to the housing 12 over the rotor/profile assembly to close the pumping chamber.

By manufacturing the cam profile liner 16 from two identical cam profile halves, a sophisticated cam profile can be produced which is much less expensive than machined cam profiles, or profiles molded as a single unit requiring special tooling or hand inserts to create the window openings 36 in the cam profile liner. Accordingly, complicated tooling and the need for hand-placing inserts, which is expensive and slows the molding cycle rate, are eliminated. Moreover, a taper is not required to be formed in the inner surface 51 of the cam profile 16 since there is no need to withdraw a center mold contour. The mold parting line, as shown, is chosen to require only one mold for fabricating both liner halves.

Referring to FIG. 5, a conventional sliding vane pump 60 having a sophisticated continuous cam profile liner 16 formed from two halves 40 and 42, such as that discussed in reference to FIG. 1. Each cam profile half is formed from a single mold, and thus, each half is identical to the other. The cam profile inner surface is smooth and continuous, and importantly for pumps of this type, does not have a taper. A rotor 62 having a plurality of sliding vanes 64 is rotatably mounted within cam profile liner 16. Accordingly, precision sliding vane pumps can implement these molded cam profile liners formed from multiple pieces since performance is acceptable.

In summary, a method for manufacturing a sophisticated continuous cam profile liner is disclosed. This method includes forming the cam profile liner from multiple pieces, and preferably, from two identical cam profile halves. Each cam profile half is manufactured using conventional molding techniques from a single mold, using plastic molding or die casting techniques. Since the cam profile liner is manufactured from two halves, windows can be formed in the cam profile liner without the need for hand-placing inserts in the mold, which would Otherwise require expensive tooling and slow the molding cycle rate considerably. Moreover, the inner surface of the cam profile liner is smooth and without a taper. Accordingly, precision sliding vane pumps can be manufactured with sophisticated cam profile liners using this technique. Expensive computer controlled milling machines are not required to form non-circular profiles for use with sliding vane, roller or flexible (rubber) impeller bodies. Molding costs are reduced up to 75% from costs associated with molding a unitary cam profile.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

We claim:

1. A method of manufacturing a device having a housing, a cam profile liner with a pumping chamber, said cam profile liner having a fluid inlet port and a fluid outlet port formed therein in communication with said pumping chamber, a rotor rotatably mounted within said pumping chamber, and a motor connected to said rotor for driving said rotor, comprising the steps of:

(a) forming a plurality of cam profile liner units;

(b) integrating together said plurality of cam profile liner units to form said cam profile liner;

(c) integrating said cam profile liner into said housing;

(d) integrating said rotor into said cam profile liner; and (e) attaching said motor to said rotor.

2. The method as specified in claim 1 including the step of forming said plurality of cam profile liner units from plastic material using injection molding techniques.

3. The method as specified in claim 1 including the step of providing said cam profile liner with an anti-rotation pin extending therefrom, said pin engaging said housing once assembled therein to prevent rotation of said cam profile liner within said housing.

4. The method as specified in claim 1 wherein a pair of cam profile liner units are molded, and then integrated together to form said cam profile liner.

5. The method as specified in claim 1 including the step of molding a pair of identical cam profile liner units, and then integrating said units together to form a symmetric said cam profile liner.

6. The method as specified in claim 4 including the step of forming each said cam profile liner unit to have at least one opening defined therethrough which serves as either said fluid inlet port or said fluid outlet port for said device once integrated together.

7. The method as specified in claim 6 including the step of forming each said cam profile liner unit to have a plurality of said openings defined therethrough.

8. The method as specified in claim 5 including the step of forming each said cam profile liner unit to have an inner arcuate surface with an inner diameter continuously blending from a predetermined diameter to a smaller diameter, wherein the respective said predetermined and smaller diameter portions of each said cam profile unit are joined together to form said cam profile liner with a continuous inner surface.

9. The method as specified in claim 1 including the step of providing a flexible said rotor.

10. The method as specified in claim 1 including the step of providing a sliding vane type said rotor.

11. The method as specified in claim 1 including the step of providing said rotor with a plurality of rollers.

* * * * *